US006852380B2

(12) United States Patent
Tremblay

(10) Patent No.: US 6,852,380 B2
(45) Date of Patent: Feb. 8, 2005

(54) SEALING DEVICE FOR DOUBLE GLAZED WINDOW ASSEMBLY

(75) Inventor: Luc Tremblay, Boucherville (CA)

(73) Assignee: Tec-N-Tec Inc., Quebec (CA)

( * ) Notice: Subject to any disclaimer, the term of this patent is extended or adjusted under 35 U.S.C. 154(b) by 0 days.

(21) Appl. No.: 10/433,187

(22) PCT Filed: Nov. 20, 2001

(86) PCT No.: PCT/CA01/01635

§ 371 (c)(1),
(2), (4) Date: Oct. 28, 2003

(87) PCT Pub. No.: WO02/46562

PCT Pub. Date: Jun. 13, 2002

(65) Prior Publication Data

US 2004/0060248 A1 Apr. 1, 2004

(30) Foreign Application Priority Data

Dec. 7, 2000 (CA) ..... 2327842

(51) Int. Cl.[7] ..... E06B 3/24; E04C 2/54
(52) U.S. Cl. ..... 428/34; 52/204.52; 52/786.13
(58) Field of Search ..... 428/34, 192; 52/204.52, 52/302.7, 786.1, 786.13

(56) References Cited

U.S. PATENT DOCUMENTS

| | | | | |
|---|---|---|---|---|
| 4,183,693 A | * | 1/1980 | Berdan | 403/295 |
| 4,817,354 A | | 4/1989 | Bayer | |
| 5,209,599 A | * | 5/1993 | Kronenberg | 403/298 |
| 5,345,734 A | | 9/1994 | Tremblay | |

FOREIGN PATENT DOCUMENTS

GB 1 161 785 8/1969

* cited by examiner

*Primary Examiner*—Donald J. Loney
(74) *Attorney, Agent, or Firm*—Merchant & Gould P.C.

(57) ABSTRACT

A sealing device for use in a sealed double glazed window assembly is described and consists of a pair of glass sheets arranged in spaced parallel relationship to form an air space therebetween and of a spacing unit disposed between the inner marginal edges of the glass sheets. The device comprises a flexible plug that fits into holes made in the spacing unit. A blind rivet is used within the plug and consists of a deformed sleeve member and of a ruptured annular member coaxially positioned within the sleeve member. The bottom wall of the plug is made of piercable material so that a piercing member may be introduced in the cavity to penetrate through the bottom wall to thereby have access to the space between the sheets.

9 Claims, 2 Drawing Sheets

SEALING DEVICE FOR DOUBLE GLAZED WINDOW ASSEMBLY

FIELD OF THE INVENTION

The present invention relates to a sealing device for use with a sealed double glazed window assembly which is formed of a pair of glass sheets arranged in spaced parallel relationship to one another and of a spacing unit disposed between the inner marginal edges of the glass sheets.

BACKGROUND OF THE INVENTION

In this type of window assembly, it is usual to replace the air in the space between the glass sheets with a gas to improve the insulation of the double glazed unit. To achieve this, one or two holes are made in the spacing unit.

One such sealing device for double glazed window assembly is described in U.S. Pat. No. 5,345,734 issued Sep. 13, 1994 to Applicant. In this sealing device, a flexible plug is provided to fit into holes made in the spacing unit to allow the gas to be injected into the space between the sheets. A blind rivet is used with the plug. An outward pull is exerted on the rivet causing an expansion of the plug to thereby sealingly contain the gas injected between the glass sheets. With this sealing method, the enlarged head portion of the stem of the rivet remains in the sealing device so that no further access is provided to test or to obtain information as to the condition of the gas present in the space between the two glass sheets.

OBJECTS AND STATEMENT OF THE INVENTION

It is an object of the present invention to provide a sealing device which is adapted to be inserted into holes made in the spacing unit of the sealed double glazed window assembly immediately.

It is a further object of the present invention to provide a sealing device which, after the sleeve member has been deformed to expand the plug in the hole of the spacing unit, enables the insertion of some means therein to reach between the glass sheets and to obtain information concerning the conditions of the glass unit.

This is achieved by providing a blind rivet which, although used to deform a sleeve member, still enables the introduction of a piercing member into the plug cavity to pierce the bottom wall of the sleeve member so as to reach the space between the glass sheet.

The present invention therefore relates to a sealed double glazed window assembly which comprises:

- a flexible plug adapted to fit into the holes; the plug defining a hollow cavity having an open end terminating at the outer face of the spacing unit and a bottom wall opposite the open end; the plug being formed of a piercable material in at least the bottom wall thereof;
- a blind rivet having a portion extending within the cavity of the plug, the rivet comprising:
  - a. a deformed sleeve member received in the cavity;
  - b. a ruptured annular member coaxially positioned in the sleeve member; the annular member being defined as an enlarged head position of a rupturable stem initially positioned in the cavity; the stem including a portion extending outside the plug when inserted in the cavity and connected to the enlarged portion through a frangible neck; the sleeve member having been deformed by an outward pulling action exerted on the outside portion of the stem whereby the enlarged head portion is forcibly engaged in the sleeve member and deforms the sleeve member to expand the plug in the hole of the spacing unit to thereby seal the glass sheets; the annular member, after rupture of the stem and retrieval of the outside portion, allowing insertion of a piercing member in the cavity and penetration through the bottom wall to have access to the inside of the glass sheets.

In preferred forms of the invention, the plug is made of a plastic material, such as nylon, which is resistant to ultraviolet radiation while the sleeve member is made of aluminium and the annular member is made of steel.

Other objects and further scope of applicability of the present invention will become apparent from the detailed description given hereinafter. It should be understood, however, that this detailed description, while indicating preferred embodiments of this invention, is given by way of illustration only since various changes and modifications within the spirit and scope of the invention will become apparent to those skilled in the art.

DESCRIPTION OF PREFERRED EMBODIMENTS

Figure 1:
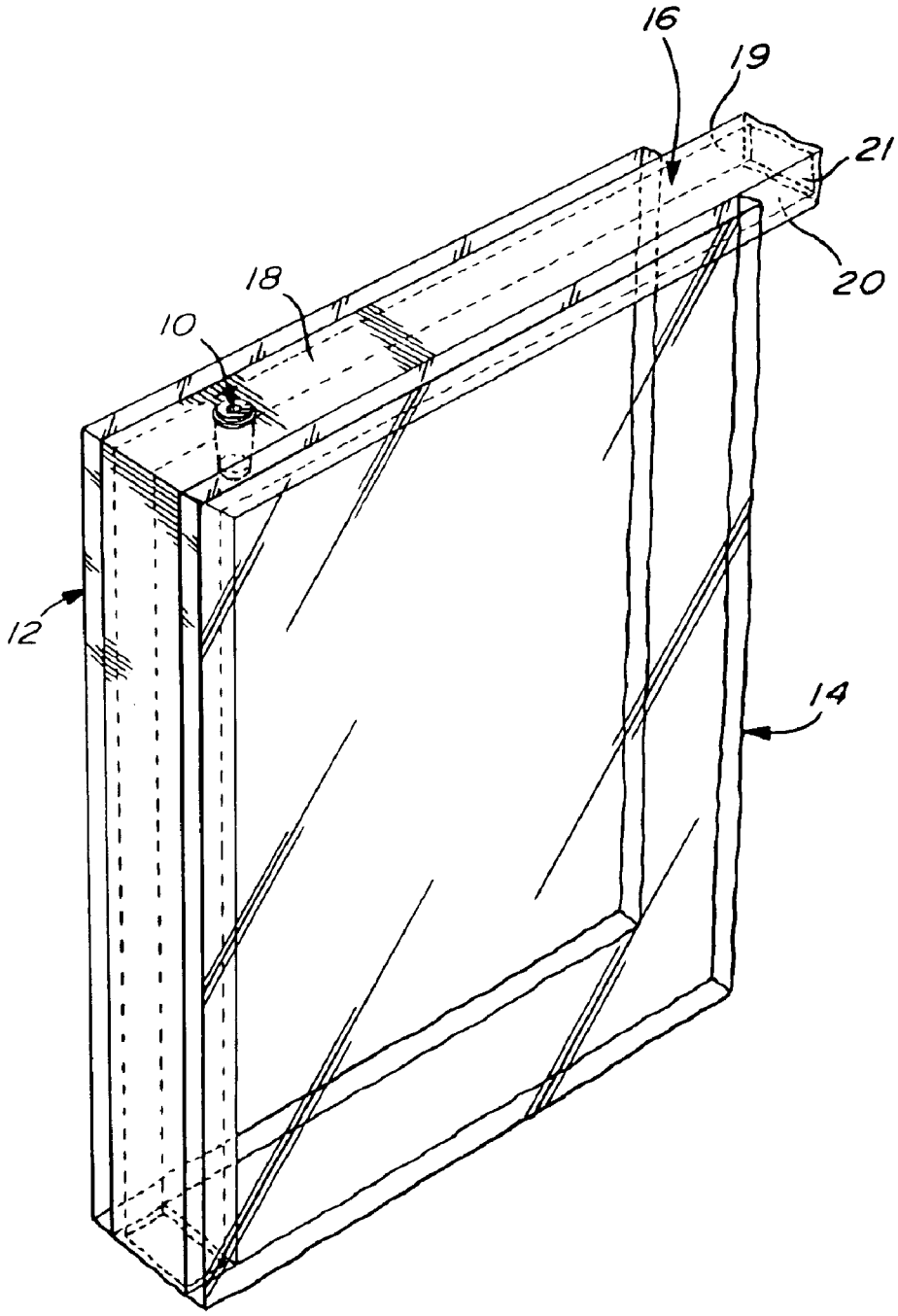
FIG. 1 is a perspective view showing part of a window assembly with a sealing device made in accordance with the present invention.

Referring to FIG. 1, there is shown a sealing device, generally denoted 10, being fitted in a window assembly consisting of a pair of glass sheets 12 and 14 arranged in spaced parallel relationship to one another and of a rectangular spacing unit 16 having an inner wall 18 and an outer wall 20 and opposite side walls 19 and 21 in sealed contact with the marginal edges of the glass sheets.

There is a great variety of window assemblies and their construction is well known in the art; therefore, further detailed description of the window construction illustrated is not deemed necessary. However, it is now more and more requested to replace the air between the glass sheets with a gas, such as argon, to improve the thermal barrier between both sides of window assemblies. To achieve this, it is necessary to drill holes in the spacing unit of the window assembly so that gas may be injected from one hole between the glass sheets and air may exit from a second hole (not shown), preferably on the opposite spacing unit of the window assembly. Also, it is sometimes required to analyse the conditions of the gas between the glass sheets.

The present invention is therefore concerned with first providing a sealing plug to be inserted into these holes after the gas has been injected and secondly to allow some inspection, later on, of the gas conditions between the two glass sheets with the possibility of balancing the air pressure in the unit before installation and of evaluating the status of the unit.

Figure 2:
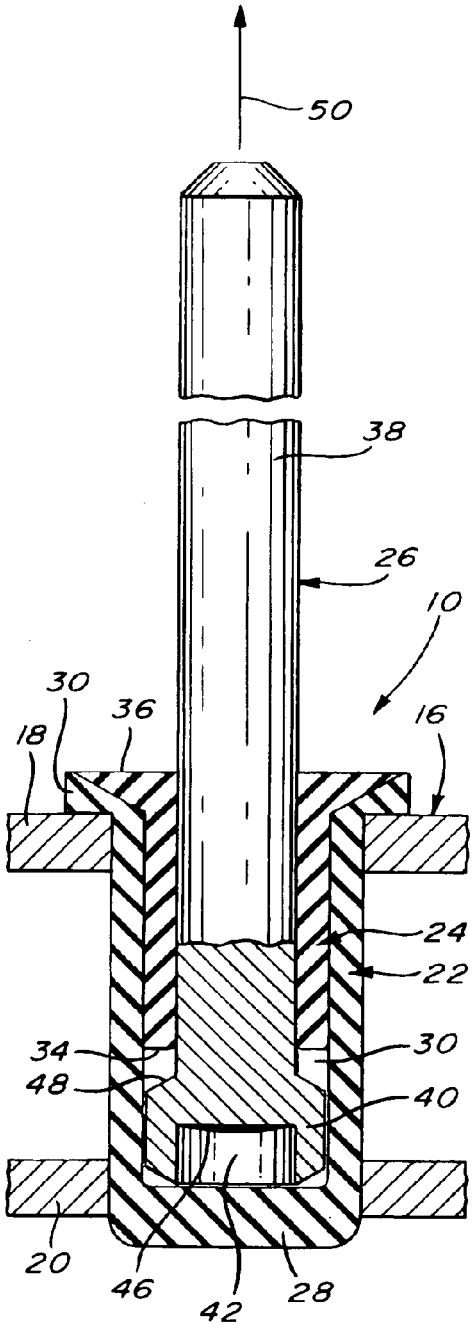
FIG. 2 is a cross-sectional view showing the sealing device inserted into the spacing unit prior to rupture.

Referring to FIG. 2, the sealing device 10 comprises a flexible cylindrically shaped plug 22 and a blind rivet consisting of a sleeve member 24 and of a stem 26. The plug 22 has a closed bottom wall 28 to define a hollow cavity 30.

In the embodiment illustrated, plug 22 traverses outer face 18 and inner face 20 of the spacing unit 16. The open end of the plug has a peripheral flange 30 that rests on the outer face 18 of the spacing unit adjacent the hole. One preferred material for the plug is plastic, such as nylon, which is resistant to ultraviolet radiation and a good vapor resistance.

The sleeve member 24 is made of a deformable or expandable material, for example aluminum; it has a cylindrical bore 32 (see FIG. 3) and its lower extremity 34 terminates short of the bottom wall 28 of the plug. The sleeve member has, at its upper end, a tapered flange 36 which has an inclined under face which is adapted to rest against the correspondingly shaped upper face of the peripheral flange 30 of the plug.

The stem 26 has an elongated portion 38 extending outside the plug and an enlarged head portion 40 resting inside the plug on the bottom wall 28. The outer diameter of the enlarged head portion 40 is greater than the inner diameter 32 of the sleeve member 24. The lower end of the head portion 40 displays a circular recess 42; the depth of this recess is such that the distance separating its inner wall 46 and the outer inclined wall 48 is about 60% of the diameter of the stem 38.

Figure 3:
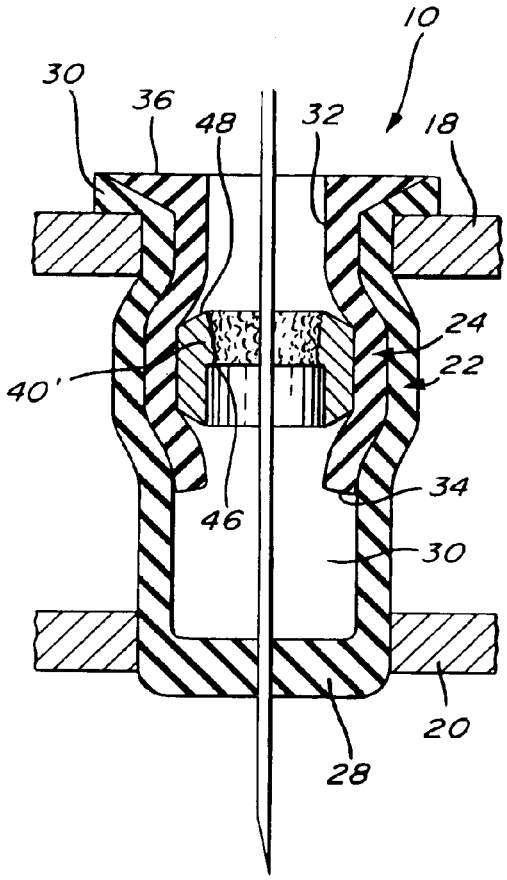
FIG. 3 is a cross-sectional view showing the device in sealing engagement with the spacing unit of the window assembly.

Referring to FIG. 3, to deform the device in order to give it a sealing function, an outward pull, in the direction of arrow 50, is exerted on stem portion 38 forcing the enlarged head portion 40 upwardly into the bore wall 32 of the sleeve member 24. This pulling action causes the sleeve member to expand radially outwardly causing the plug 22 to expand also and to form a tight sealing engagement under the wall 18 of the spacing unit, sealing being further secured by a squeezing engagement in the area of the peripheral flange 30 of the plug. As a result of the outward pull, the stem portion 38 is ruptured in the area of surface 48 so that only the head portion 40 of the stem in the shape of an annular member 40' remains inside the plug. Although not shown, the plane of face 36 of the sleeve member could be further moved into the plane of face 18 if, at the time of drilling the holes, that area of the spacing unit is slightly deformed inwardly.

The bottom wall 28 of the plug is made of a piercable resilient material so that a needle 52, for example, may be permitted to traverse the bottom wall 28 and reach the space between the glass sheets so that a reading of the gas existing therebetween may be made. The material of the bottom wall is such that, once the needle is retracted, gas is still confined between the glass sheets.

Although the invention has been described above with respect with one specific form, it will be evident to a person skilled in the art that it may be modified and refined in various ways. It is therefore wished to have it understood that the present invention should not be limited in scope, except by the terms of the following claims.

What is claimed is:

1. In combination, a sealed double-glazed window assembly comprising a pair of glass sheets arranged in spaced parallel relationship to form an air space therebetween and a spacing unit disposed between the inner marginal edges of the glass sheets, said spacing unit having an inner face and outer face, each said face having a hole in registry with one another, to enable the injection of a gas in said space; and a sealing device comprising:

a flexible plug adapted to fit into said holes; said plug defining a hollow cavity having an open end terminating at said outer face of said spacing unit and a bottom wall opposite said open end; said plug being formed of a piercable material in at least said bottom wall thereof;

a blind rivet having a portion extending within said cavity of said plug, said rivet comprising:

a. a deformed sleeve member received in said cavity;

b. a ruptured annular member coaxially positioned in said sleeve member; said annular member being defined as an enlarged head position of a rupturable stem initially positioned in said cavity; said stem including a portion extending outside said plug when inserted in said cavity and connected to said enlarged portion through frangible neck; said sleeve member having been deformed by an outward pulling action exerted on said outside portion of said stem whereby said enlarged head portion is forcibly engaged in said sleeve member and deforms said sleeve member to expand said plug in said hole of said spacing unit to thereby seal the glass sheets; said annular member, after rupture of said stem and retrieval of said outside portion, allowing insertion of a piercing member in said cavity and penetration through said bottom wall to have access to the inside of the glass sheets.

2. A sealing device as defined in claim 1, wherein said plug is formed of a plastic material resistant to ultra-violet radiation.

3. A sealing device as defined in claim 1, wherein said plug has an upper peripheral flange resting on the outer face of said spacing unit about said hole.

4. A sealing device as defined in claim 3, wherein said plug has an outer cylindrical wall with an outer diameter corresponding substantially to the diameter of the hole made in the spacing unit.

5. A sealing device as defined in claim 4, wherein said sleeve member is tubular in shape with one end thereof having a peripheral flange resting on the upper peripheral flange of said plug.

6. A sealing device as defined in claim 1, wherein said spacing unit has a rectangular shape and wherein said plug extends through holes coaxially provided in said inner and outer faces of said spacing unit.

7. A sealing device as defined in claim 1, wherein said annular member is made of steel.

8. A sealing device as defined in claim 1, wherein said sleeve member is made of aluminum.

9. A sealing device as defined in claim 1, wherein said piercable material is nylon.

* * * * *